US007237944B2

(12) United States Patent
Hardy et al.

(10) Patent No.: US 7,237,944 B2
(45) Date of Patent: Jul. 3, 2007

(54) SCRAPED HEAT EXCHANGER HAVING BLADE WITH PROTECTIVE REST NUB

(75) Inventors: Benjamin Hardy, Elkorn, WI (US); Curt Hagen, Delavan, WI (US); Gary Ferguson, Milton, WI (US)

(73) Assignee: SPX Corporation, Charlotte, NC (US)

( * ) Notice: Subject to any disclaimer, the term of this patent is extended or adjusted under 35 U.S.C. 154(b) by 211 days.

(21) Appl. No.: 10/747,156

(22) Filed: Dec. 30, 2003

(65) Prior Publication Data

US 2005/0141343 A1 Jun. 30, 2005

(51) Int. Cl.
*F28F 5/00* (2006.01)

(52) U.S. Cl. ..... 366/311; 366/312; 165/94; 165/DIG. 90; 165/DIG. 91

(58) Field of Classification Search ..... 165/DIG. 81, 165/DIG. 90, DIG. 91, 94; 15/93.1, 236.01, 15/236.05, 236.1; 366/67, 309, 311–313
See application file for complete search history.

(56) References Cited

U.S. PATENT DOCUMENTS

| | | | | | |
|---|---|---|---|---|---|
| 864,632 | A * | 8/1907 | Fegley | 366/311 |
| 1,672,218 | A * | 6/1928 | How | 366/311 |
| 1,692,964 | A * | 11/1928 | Thompson | 165/94 |
| 1,765,315 | A * | 6/1930 | Thompson | 366/311 |
| 1,820,954 | A * | 9/1931 | Tuck | 366/67 |
| 3,848,289 | A * | 11/1974 | Bachmann | 15/246.5 |
| 4,185,352 | A * | 1/1980 | Smith | 15/246.5 |
| 4,571,091 | A * | 2/1986 | Pardo et al. | 366/311 |
| 4,790,667 | A * | 12/1988 | Pardo et al. | 366/311 |
| 5,462,408 | A * | 10/1995 | Coffy | 416/134 A |
| 5,518,067 | A * | 5/1996 | Finch et al. | 165/92 |
| 6,966,757 | B2 * | 11/2005 | Hardy et al. | 416/204 R |
| 2003/0112701 | A1 * | 6/2003 | Burchett | 366/139 |
| 2005/0132516 | A1 * | 6/2005 | Hardy et al. | 15/104.09 |

* cited by examiner

*Primary Examiner*—David Sorkin
(74) *Attorney, Agent, or Firm*—Baker & Hostetler LLP

(57) ABSTRACT

Attachment apparatus and method for interlocking attachment of a scraper blade with a drive shaft of a scraped surface heat exchanger includes a blade having dual attachment beams and a central locking member, and at least one pin having dual fingers each for interlocking with a respective attachment beam. The blades feature protective supporting nubs that are outwardly facing from the blade and located proximate to the mounting locations of the blade to provide a supporting rest for the drive shaft pin and blade assembly as it is slid into or out of its outer housing tube.

17 Claims, 9 Drawing Sheets

SCRAPED HEAT EXCHANGER HAVING BLADE WITH PROTECTIVE REST NUB

FIELD OF THE INVENTION

The invention pertains to the field of process equipment. More particularly, the invention pertains to the attachment of blades to a rotating drive shaft, such as for example in scraped surface heat exchangers.

BACKGROUND OF THE INVENTION

Scraped surface heat exchangers are a type of mixing apparatus well known in industry. Scraped surface heat exchangers generally feature an outer cylindrical housing tube and a central rotatable drive shaft disposed in the center of the outer housing tube. An annular space is provided between the central drive shaft and the outer housing tube, and material is forced from one end of the scraped surface heat exchanger through the annular space between the shaft and tube.

In general, the material enters the space between the shaft and tube near one end of the scraped surface heat exchanger and travels longitudinally along the scraped surface heat exchanger and exits near the other end of the scraped surface heat exchanger. During this time, the material can be mixed by blades which are attached to, and extend outward from, the central shaft and are rotated by the central shaft. The material may also be subject to temperature gradients as it travels along the scraped surface heat exchanger so that the material is heated or cooled.

The blades are sometimes very generally flat blades which are mounted in a pivotable fashion proximate to the surface of the central drive shaft. The blades extend outward at a relatively narrow angle from the central drive shaft and generally have a tip feature at their distal end which is in sliding contact with the inner surface of the outer housing cylinder as the blades are rotated.

The blades are generally elongated, and typically several blades are provided along the length of the scraped surface heat exchanger to occupy the length of the inner volume of the scraped surface heat exchanger. The blades serve at least some of several functions. For example, the blades can enhance overall mixing of the material as it passes along the inner volume of the scraped surface heat exchanger. The blades also can contact the inner housing of the scraped surface exchanger to in effect scrape material off the inner surface so that it does not build up on the inner surface of the housing cylinder. Further, the blades can add to general flow patterns within the heat exchanger which facilitate temperature transfer from the outer housing of the heat exchanger to the material itself. The outer housing may have a fluid jacket or other heating or cooling source to impart a desired temperature to the outer housing, so that the material can be heated or cooled as it travels through the device.

It has been known to mount the blades to the central driving shaft using so-called "pins". The pins are individual items that are attached, usually by welding, to the drive shaft surface and have some sort of receptacle area to accept a part of the blade so the blade is pivotally positioned. Two or more pins are usually used on the length of a single blade to pivotally support one blade at the locations of the pins. Previously, the blades have had a cutaway portion forming a hinge shaft or single "attachment beam" that is received in the receptacle slot of the pin to form a hinge configuration.

As noted above, the pins are typically spaced apart longitudinally along the length of the drive shaft, with two or more pins being used for each blade. For simplicity and manufacturing costs reasons, for a given length of heat exchanger it is typically desirable to reduce the number of blades and even further to reduce the number of pins. Thus, it is desirable typically to use relatively longer blades if possible, and it would be desirable to reduce the number of pins for each blade as well.

However, there can be some drawbacks to using longer blades and fewer pins when using the aforementioned prior art pin connection methods. In the prior art, the blades have tended to have relatively short attachment beams due to shear and buckling failure modes. Due to the possibility of flexing of the entire blade between the attachment points, there is a need to place the beams and pins at certain regularly defined intervals.

Another disadvantage with at least some conventional pin and beam attachment systems has been that during assembly of the device, the blade may fall out of its pin receptacle depending on the manufacturing angle of the shaft, pin, and blade.

A different disadvantage with at least some conventional pin and beam attachment systems has been that scraping of the top of the pin against the inside of the outer tube can occur during installation and removal of the drive shaft with the pins and the blades. By way of example, for installation of a drive shaft, it is common practice to first mount each blade into its pivotal connection with its respective pins. Then, the drive shaft itself with all the blades attached (and sometimes flopping loosely to some extent) is gradually manually slid until the tube into its full length runs along the full length of the housing cylinder and then the ends of the drive shaft can be secured to respective bearings and end caps of the housing cylinder. Removal of the drive shaft is through reverse process. Since the clearances between the outside of the drive tube and even more so the outside of the pins, with respect to the inside of the housing tube tend to be very small, it is a very difficult process to manually slide the lengthy drive shaft into the outer housing tube without having the pins contact and to some extent scrape along the inside of the drive tube. Such scraping can be highly undesirable because the surface finish of the inside of the housing tube should generally be kept at a prescribed smoothness if possible. Keeping the inner surface of the housing tube at a prescribed finish helps prevent material from getting caught in surface imperfections on the inside of the tube, which then makes it difficult to clean the inside of the tube during cleanings. Moreover, deep scratches on the inside of the outer housing can lead to premature wear of the blades which are constantly in a rotating sliding contact with the inside of the outer housing tube.

One conventional approach to overcoming this problem has been to insert some form of relatively soft plastic shim or skid between the drive shaft and the housing tube, most particularly at the bottom where gravity would tend to pull the drive shaft down, and then to gently slide the shaft into the tube. The shims can be inconvenient, however, because first of all they need to be present at each assembly and disassembly, and second they may be difficult to insert before a shaft is removed and/or be difficult to remove after a shaft has been installed. Further, in vertical mounted units, the skids can be very difficult or impossible to use.

Accordingly, it would be desirable to have an arrangement where the usually metallic mounting pins do not come in contact with the inner surface of the outer housing tube of the heat exchanger during insertion and removal of the drive shaft with the pins and blades attached.

Accordingly, there is a need in the art for a blade attachment apparatus and method that can overcome the above disadvantages in some instances, at least to some extent, for example by providing desirable support to the blade as well as by providing some degree of locking of the blade to prevent it from falling out during installation, while permitting some pivoting during assembly and operation.

SUMMARY OF THE INVENTION

The foregoing needs are met, to a great extent, by the present invention, wherein in one aspect an apparatus is provided that in some embodiments provides a protective rest nub on a blade.

In accordance with one embodiment of the present invention, a blade for use with a scraped heat exchanger having a drive shaft with at least one outwardly directed blade mounting pin, and a housing tube having an inwardly facing inner surface, is provided comprising a body having a cross section spanning between a first tip end and a second mounting end, and at least one projecting nub projecting generally radially outwardly from the blade body when the blade is in a mounted state, the nub dimensioned to project radially outwardly past the pin when the blade is in the mounted state, and dimensioned to provide a resting surface for the blade, the pin and the drive shaft and to support the blade, the pin and the drive shaft when the blade, the pin and the drive shaft are otherwise unsupported in the housing tube.

In accordance with one embodiment of the present invention, a blade for use with a scraped heat exchanger having a drive shaft with at least one outwardly directed blade mounting pin, and a housing tube having an inwardly facing inner surface, is provided comprising a body having cross section spanning between a first tip end and a second mounting end, and at least one supporting means projecting generally radially outwardly from the blade body when the blade is in a mounted state, the supporting means dimensioned to project radially outwardly past the pin when the blade is in the mounted state, and dimensioned to provide a resting surface for the blade, the pin and the drive shaft and to support the blade, the pin and the drive shaft when the blade, the pin and the drive shaft are otherwise unsupported in the housing tube.

In accordance with one embodiment of the present invention, a method for use with a scraped heat exchanger having a drive shaft with at least one outwardly directed blade mounting pin for mounting at least one blade, and a housing having an inwardly facing inner surface, is provided comprising mounting at least one blade to the drive shaft via at least one pin, and supporting the blade, the pin and the drive shaft on at least one projecting nub projecting radially outwardly from the blade, the nub dimensioned to project radially outwardly past the pin when the blade is in the mounted state, so that the nub provides a resting surface for the blade, the pin and the drive shaft to support the blade, the pin and the drive shaft when the blade, the pin and drive shaft are otherwise unsupported.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figures 1, 2:
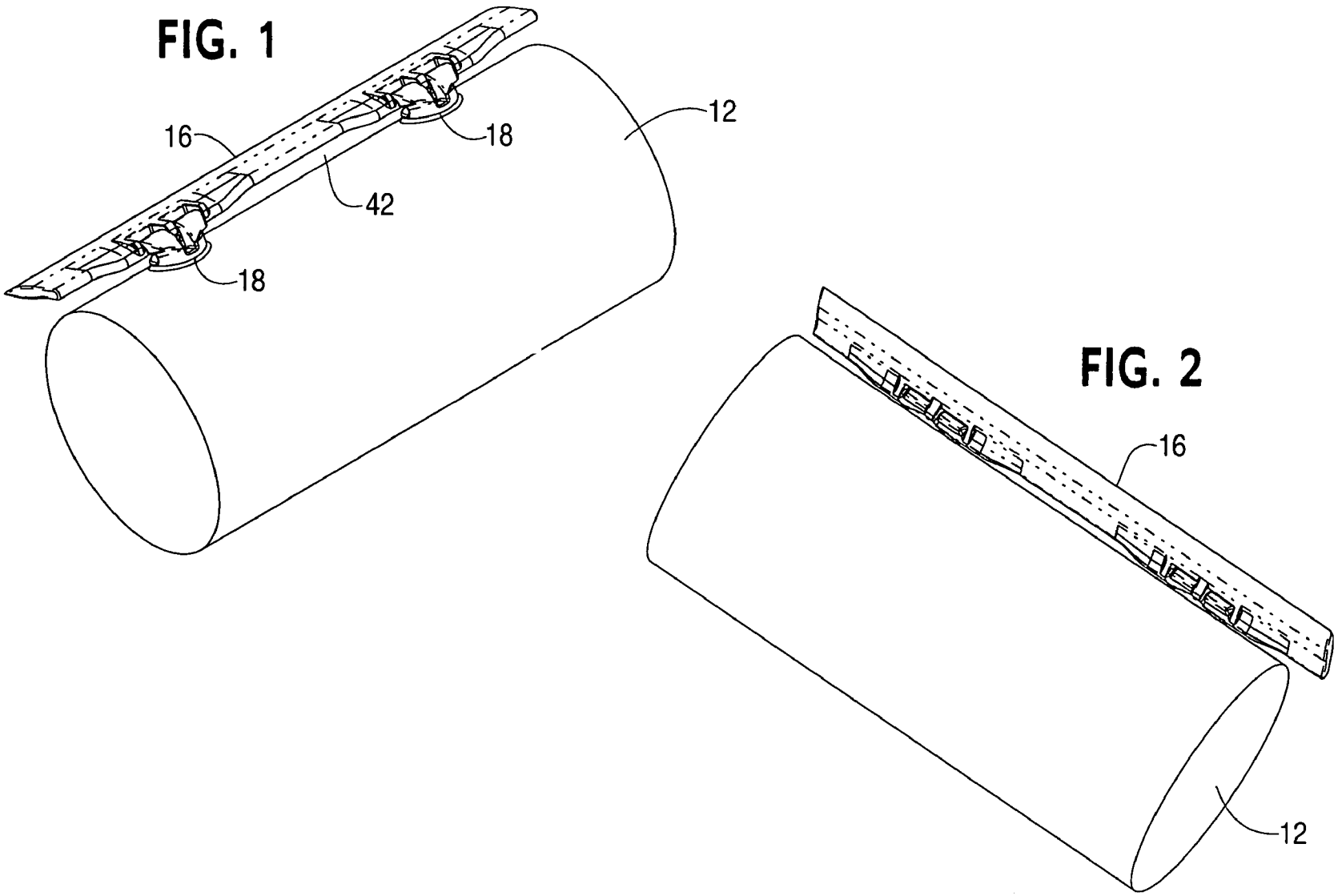
FIG. 1 is a perspective view of a portion of a scraped surface heat exchanger drive shaft using pins for attachment of a blade.
FIG. 2 is a perspective view of the items of FIG. 1 taken from a different angle.
Figure 3:
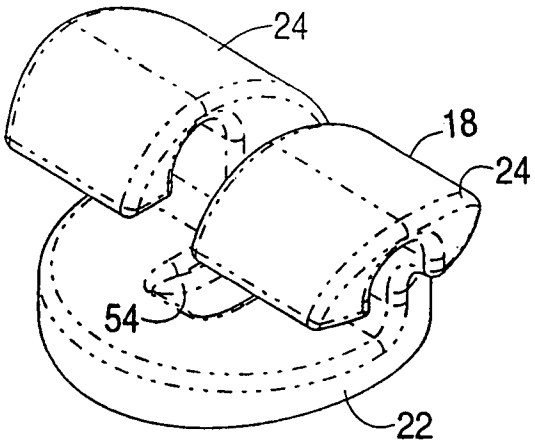
FIG. 3 is a perspective view of a mounting pin according to a preferred embodiment of the invention.

Preferred embodiments of the invention provide pivotal attachment of a blade to a drive shaft of a device such as a scraped surface heat exchanger. The invention will now be described with reference to the drawing figures, in which like reference numerals refer to like elements throughout.

Figure 10:
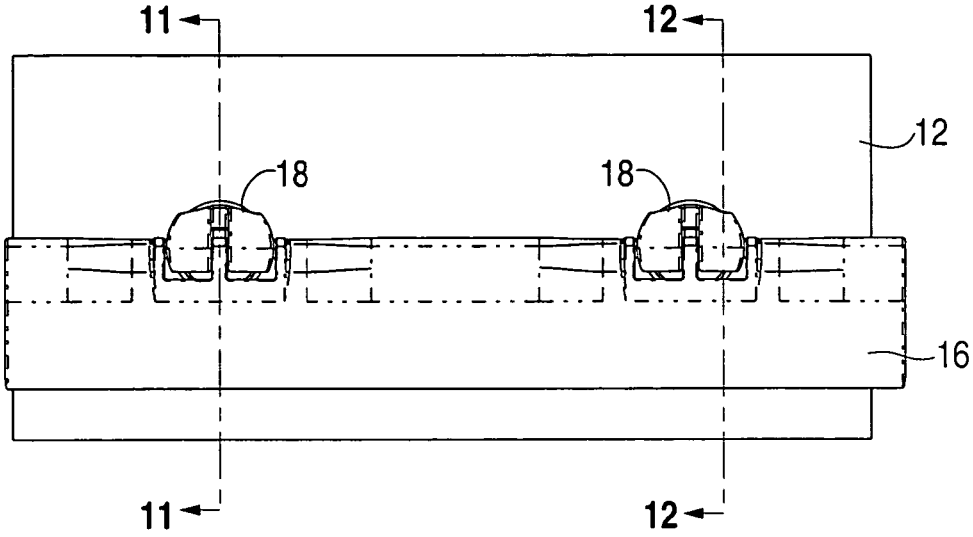
FIG. 10 is a top view of a blade, pins and a portion of a drive shaft in a fully installed and operating orientation.
Figure 11:
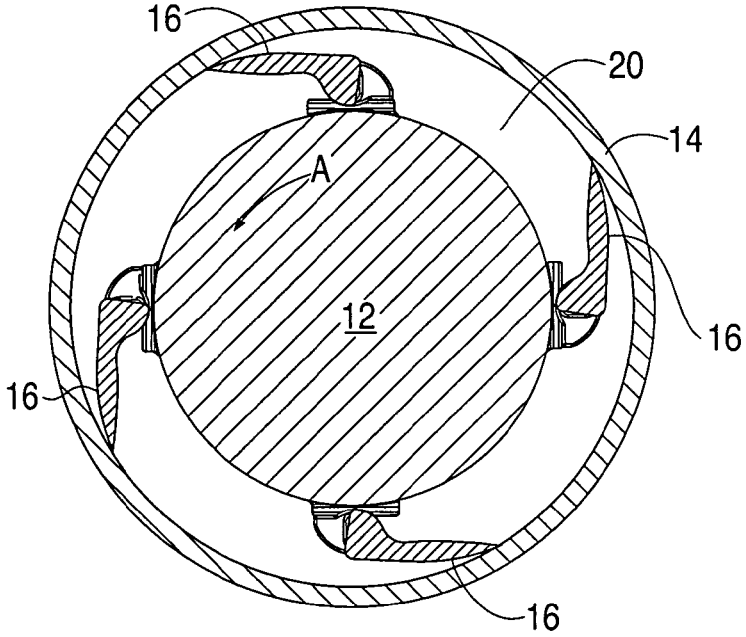
FIG. 11 is a cross sectional view taken through line 11—11 in FIG. 10, further showing an outer housing tube.

Turning to FIGS. 1, 2 and 11 initially, some components of a scraped surface heat exchanger are illustrated including a central drive shaft 12 which is powered for rotating motion, a stationary cylindrical outer housing tube 14 (seen in FIG. 11) which surrounds either concentrically or eccentrically the drive shaft 12, and a blade 16 which is mounted to the shaft by two mounting pins 18. FIGS. 1 and 2 as well as FIGS. 7 and 10 of this description for convenience and simplicity illustrate a single blade 16 mounted to a portion of a shaft 12 of the scraped surface heat exchanger. However, there are preferably several blades 16 at even circumferential angles around the shaft 12 as illustrated for example by the four blades 16 in FIG. 11.

A space 20 is provided between the drive shaft 12 and the inner surface of housing tube 14 through which material passes longitudinally along the length of the scraped surface heat exchanger and travels along the longitudinal axis of the shaft 12 and the housing 14. As the material moves through the space 20, it is scraped and/or mixed by the blade 16 due to rotation of the shaft 12.

The operative direction of rotation of the shaft 12 in FIG. 11 is shown by the arrow A. It will be appreciated that as the material resists the motion being imparted by the blade 16, the material tends to urge the blades 16 outward and into sufficiently firm scraping contact with the inner surface of the housing tube 14. The housing tube 14 will usually be heated or cooled as known in the art of scraped heat exchangers, for example by having a fluid cooling or heating jacket or other type of heating or cooling element associated therewith.

FIG. 3–6 illustrate preferred pin 18 in more detail. The preferred pin 16 features a base 22 which has a curved bottom as shown for attachment to the outer surface of the central drive shaft 12. The pin 18 is typically welded to the drive shaft 12 but may by attached by other affixing types. The pin 18 also features two relatively wide generally hook-shaped fingers 24 which can preferably together extend a width greater than the width of the base 22. The fingers 24 have an interior edge shape that forms a receptacle 26 that interacts with various features of the blade 16 as described in more detail below. Specifically, the receptacle 26 has a lower edge 28, a side edge 30 and a generally semi-circular concave portion 32 which is defined by the interior or underside of the hook portion 34 of the pin 18.

Figure 7:
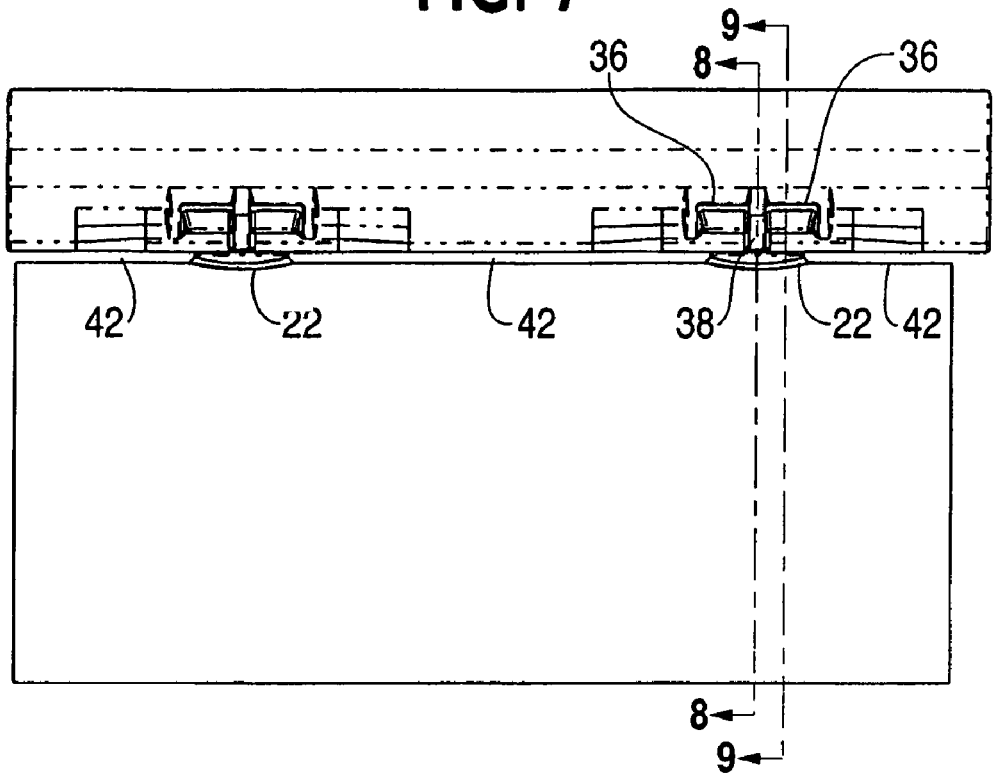
FIG. 7 is a side view of a portion of a drive shaft and scraped surface heat exchanger, showing mounting pins and a blade during the installation process.
Figure 8:
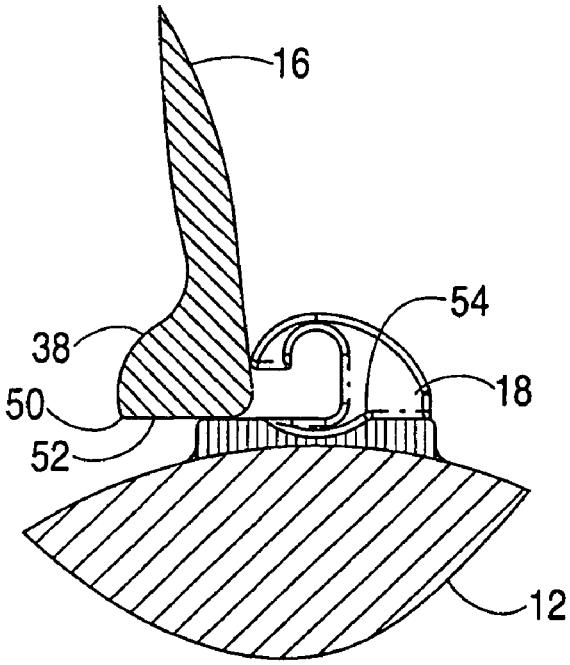
FIG. 8 is a cross sectional view taken through line 8—8 in FIG. 7.
Figure 9:
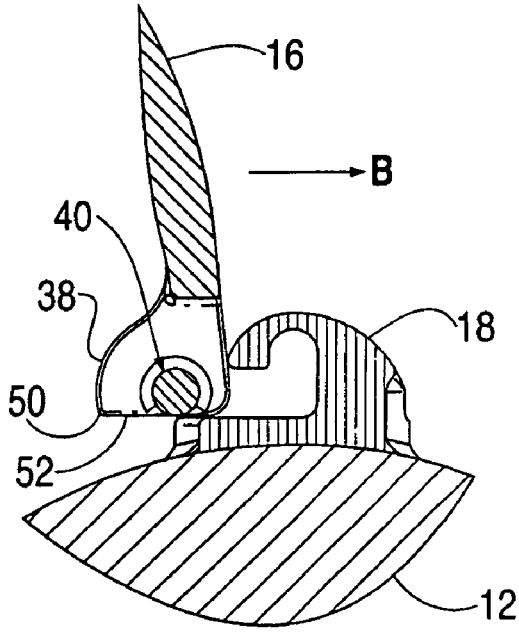
FIG. 9 is a cross sectional view taken through line 9—9 in FIG. 7.

Turning to FIGS. 7–12, the interaction of a blade 16 with the pins 18 is illustrated. As seen in FIGS. 7, 8, and 9, the blade 16 has at a location corresponding to each pin 18 a pair of cut-out areas 36 on either side of a central locking member 38 extending outward from each side of the central supporting and locking member 38 to the other side of the cut-out 36 on each side is a respective attachment beam 40. Thus, each pin 18 is associated with a pair of attachment beams 40, also referred to as dual attachment beams 40, each associated with a respective cut-out 36. In between the two cut-outs 36 is a central locking member 38 which serves to provide support to the attachment beams 36, and which also interacts with the pin 18 to lock the blade in place during operation, and to retain the attachment beams 36 in the concave area 32 of each pin 18 as described in more detail below. The locking member 38 can also be referenced to as a locking disc 38. Also, the word cut-out does not imply manufacturing by cutting or any particular method but refers to the shape of the feature.

Looking particularly at FIGS. 7 and 10, it will be appreciated that in the illustrated embodiment a single pin having a base of a certain size is able to provide an effective support area for the blade which may be considered to be wider than the base of the pin 18 itself. Moreover, the provision of the central locking member 38 serves not only a locking function but also gives support to the attachment beams 40 to prevent flexing of the blade 16 as a whole, as well as flexing of the beams 40 within the concave region 32 of the pin 18 itself. Thus, the preferred embodiment in some instances facilitates the use of fewer pins 18 for a given length of blade 16 than was required in the prior art.

The use of fewer pins 18 for a given length of blade 16 provides significant advantages in some circumstances. For example, the cost of fixing each pin 18 to the central shaft 12 is reduced. Moreover, a larger free area 42 (the area under the blade not interfered with by the base 22 of each pin 18) is further provided than would be available if more pins 18 were needed. Providing this larger free area 42 facilitates flow of the material under the blade which can enhance mixing flow properties and also reduce the force needed to drive the central shaft drive.

Another benefit of providing dual attachment beams 40, as opposed to a single attachment beam having the same effective length as the two attachment beams, is that with the dual beams 40, each beam 40 is relatively shorter and less susceptible to bending and buckling failure. Further, the central locking element 38 provides further stiffening due to its thickness.

Figure 6:
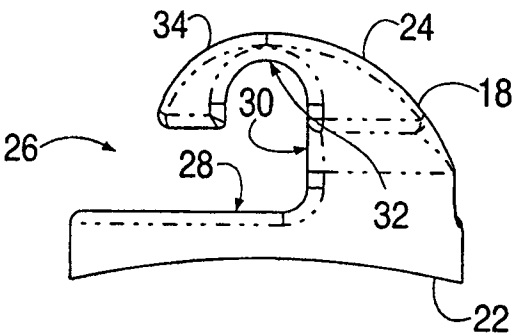
FIG. 6 is a side view of the pin of FIG. 3.
Figure 4:
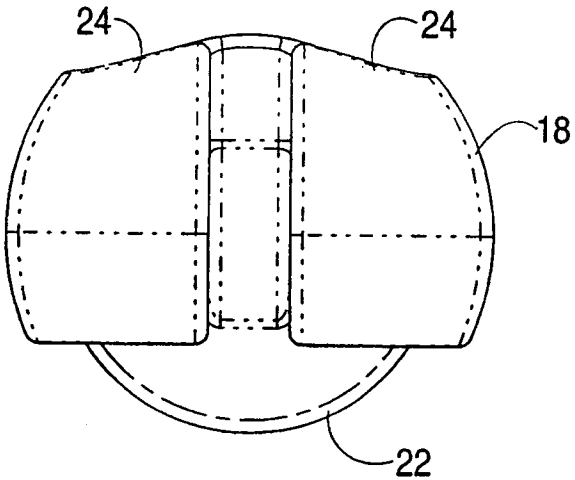
FIG. 4 is a top view of the pin of FIG. 3.
Figure 5:
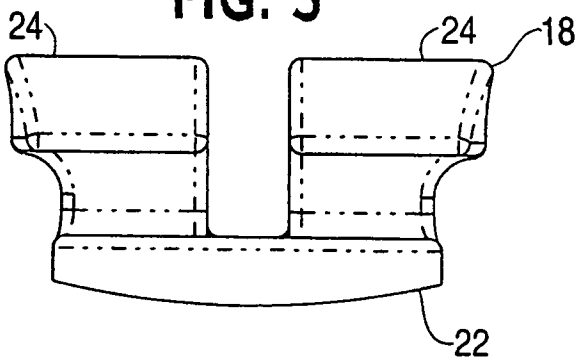
FIG. 5 is a front view of the pin of FIG. 3.

The method of installation of a blade 16 to a pin 18 will now be described in more detail with particular respect to FIGS. 6, 9 and 8. FIG. 9 illustrates the blade 16 in a configuration just at the beginning of the assembly process. The blade 16 is extending generally completely radially outward from the central drive shaft 12. In order to accomplish this arrangement, the drive shaft 12 has been removed from the outer housing 14, since when the drive shaft 12 is within the outer housing 14, the blade 16 cannot be positioned at this angle. The blade 16 has a pair of locking beams 40 extending from either side of the central locking feature 38. The central locking feature 38 has a lower cam corner 50 and a flat foot 52 as shown.

Figure 12:
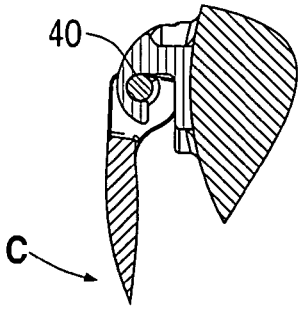
FIG. 12 is a cross sectional view taken through line 12—12 in FIG. 10 showing the blade in the configuration also shown in FIG. 11.
Figure 14:
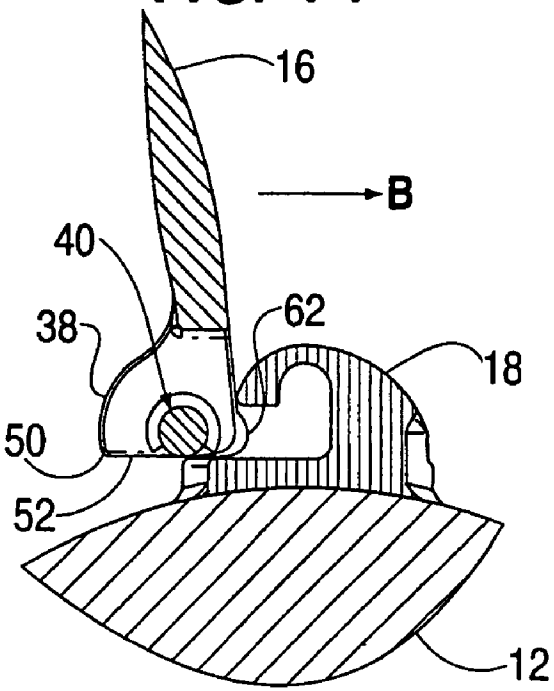
FIG. 14 is a cross sectional taken through line 9—9 in FIG. 7, showing an alternative embodiment with a protective nub rest.
Figure 13:
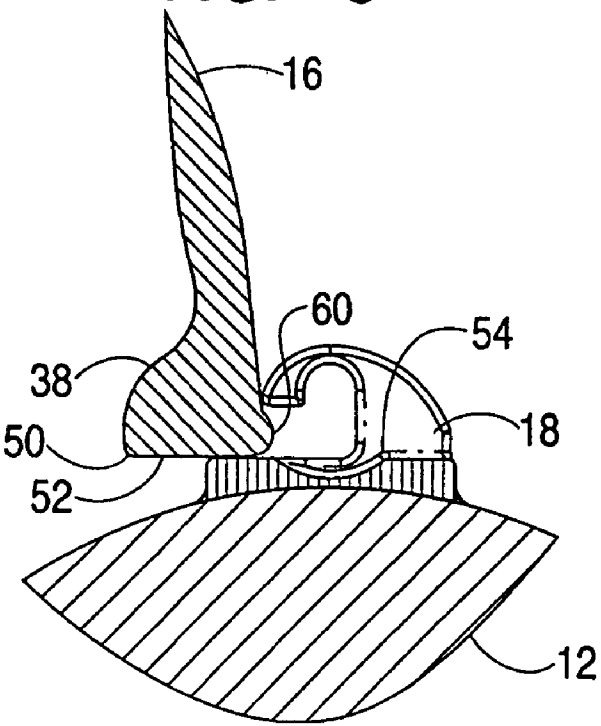
FIG. 13 is a cross sectional view taken through line 8—8 in FIG. 7 showing an alternative embodiment of a blade having a protective nub rest.

Initially, as in FIG. 9, the blade 16 is held in the generally vertical orientation and is slid in the direction shown by the arrow B. The foot 52 is generally flat and slides in the generally flat relationship along the surface 28 (FIG. 6) of the pin 18. Once it has been fully inserted so that the attachment beam 40 is resting in the corner between the surfaces 28 and 30 of the pin 18, the blade 16 is rotated in the direction shown by arrow C in FIG. 12 until it reaches substantially of the orientation shown in FIG. 12. As can be seen in FIG. 12, the attachment beam 40 is now urged into a pivoting but otherwise retrained relationship so that the surface of the attachment beam 40 is resting in the concave portion 32 (FIG. 6) of the pin 18.

The interaction of the foot 38 and the cam corner 50 with the surface 28 of the pin 18 serves to translate the attachment beam 40 upward from its position in FIG. 9 to its eventual position as shown in FIG. 12. Moreover, the interaction of the foot 38, and cam corner 50, serves to hold the pin 40 in this position so long as the blade 16 is angled substantially as shown in FIG. 12. In some embodiments it may be preferable to provide a small saddle 54 in the portion of the pin 18 between the arms 24 (see FIGS. 3 and 8). This saddle 54 receives the cam corner 50 and locking member 38 to facilitate angular motion during installation and to permit a degree of angular motion during the operative position as shown in FIG. 12.

The position shown in FIG. 12 permits the shaft 12 and associated blades 16 to be installed within the outer housing 14 as generally shown by FIG. 11. When in the installed state shown in FIG. 11, the blade 16 is prevented from rotating in a direction opposite to the direction shown by arrow C in FIG. 12. A benefit of the locking arrangement using the central locking feature 38 having a cam corner 50, and foot 52, is that the blades 16 can be easily installed, but once they are pivoted in the direction shown by arrow C in FIG. 12 to a sufficient extent, they are restrained until they are rotated oppositely by a significant amount. This can facilitate the assembly of blades 16 onto a shaft 12 during the assembly process, because the shaft 12 and associated pins 18 can be at relatively wide range of angles, without the blades 16 being able to fall off their respective pins 18.

The blades, pins and shafts may of any suitable materials as desired. In some preferred heat exchangers, the drive shaft 12 is stainless steel and the pins 18 are stainless steel items welded on to the shaft. The blade 16 is preferably made from a nonmetallic material in order to facilitate forming of desired blade shapes, and preferred blade materials include molded plastics such as Victrex PEEK (polyaryletherketone) or Ticona Celcon (acetyl copolymer). Alternatively, the blade can be for example a pressed metal such as stainless steel. A benefit of some embodiments of the present invention, is that the elongated dual attachment beams 40 can be provided, and due to the provision of the central supporting element 38 it can have a desirably long effective supporting length without being subjected to such stress that a metal strengthening insert would necessarily be required. However, the locking feature of some embodiments of some invention does not require that there be dual attachment beams with the locking feature provided on a central element. For example, alternative embodiments can include a single attachment beam extending across a single cutout. A locking feature including a foot 52, and a cam corner 50 may be provided at any location along the blade, most preferably in such an embodiment adjacent to one side of the cutout to interact with a corresponding feature on the pin. In such an embodiment, a single finger would preferably be used with a single beam, and of the saddle 56 if provided would be located to the side of the respective finger, rather than centrally between two fingers as shown in the embodiment of FIGS. 1–11.

Figure 18:
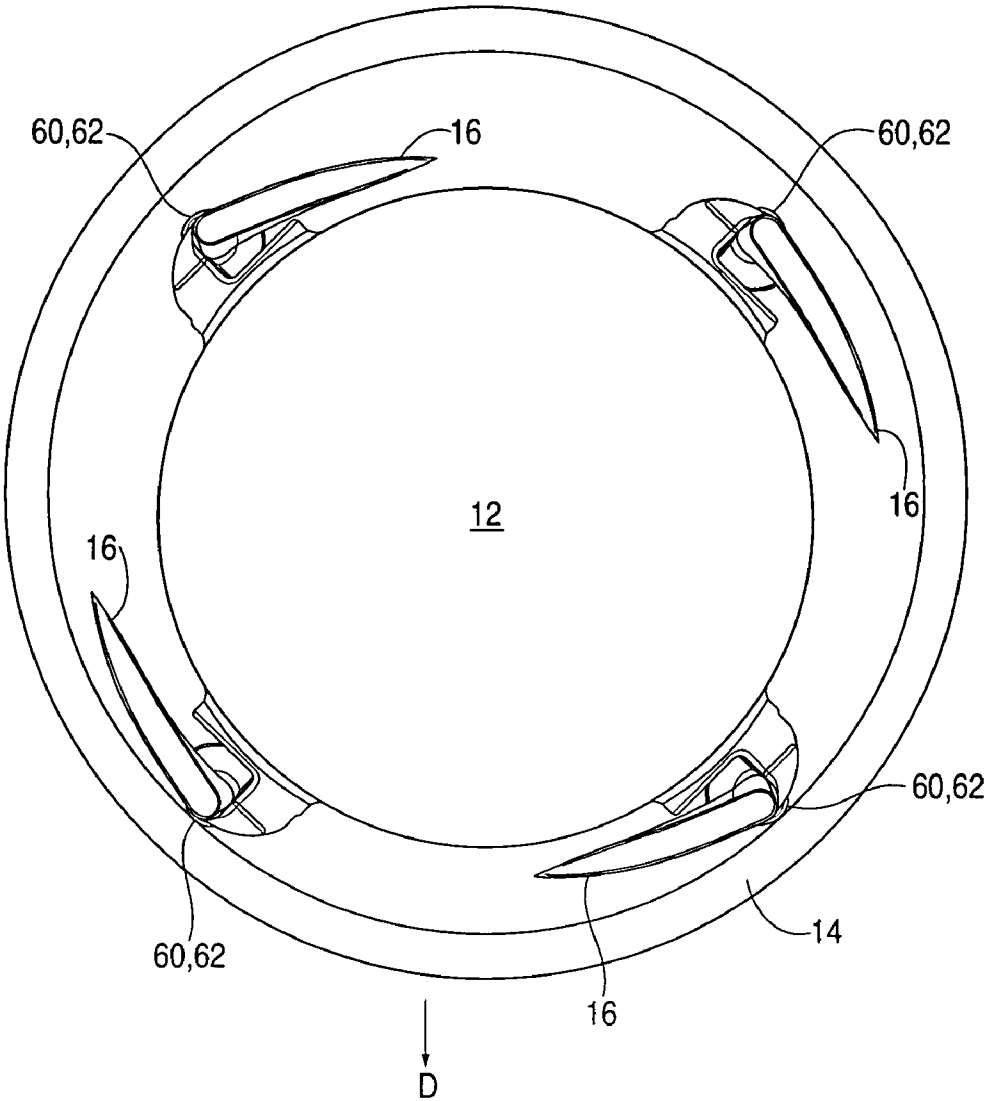
FIG. 18 is a cross sectional view similar to FIG. 16 showing the drive shaft in an unmounted position with the drive shaft being supported on nub rests an alternative blade configuration.

FIGS. 13–20 illustrate alternative embodiments of a scraped surface heat exchanger blade 16 having one or more protective rest nubs 60 and/or 62 projecting therefrom. The purpose of the rest nub 60 and/or 62 is to provide a outward projection from the blade when blade 16 it is in a position mounted to the pin 18 so that when the drive shaft 12 is disconnected from its supports and is allowed to drop down through the force of gravity, the drive shaft 12 will come to rest in a position such as shown in FIG. 18 with the nubs 60 and/or 62 in contact with the inner surface of the outer tube 14, thereby preventing the pin 18 from having any contact with the inner surface of the outer tube.

Figure 15:
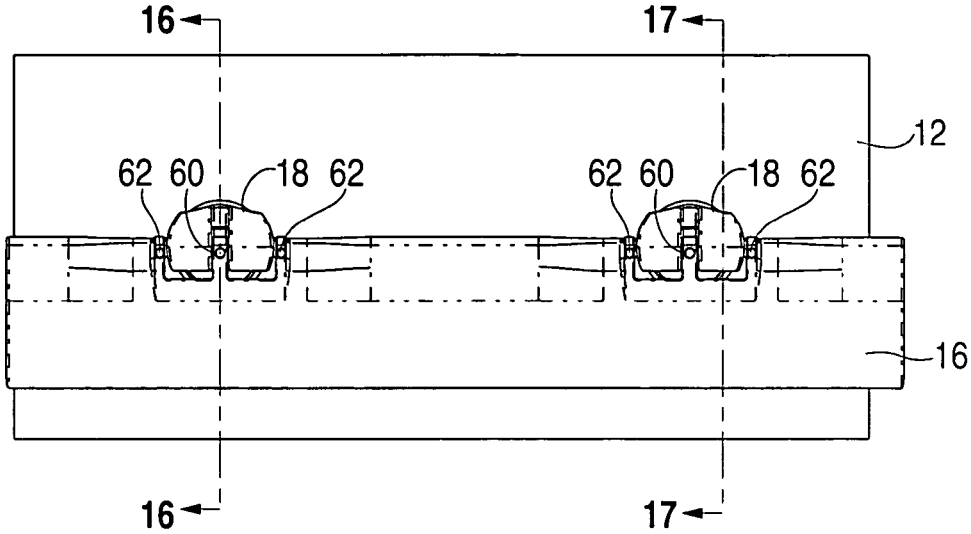
FIG. 15 is a top view of a blade, pins and a portion of the drive shaft and a fully installed and operating orientation, showing an alternative blade having a plurality of alternative nub rests.
Figure 16:
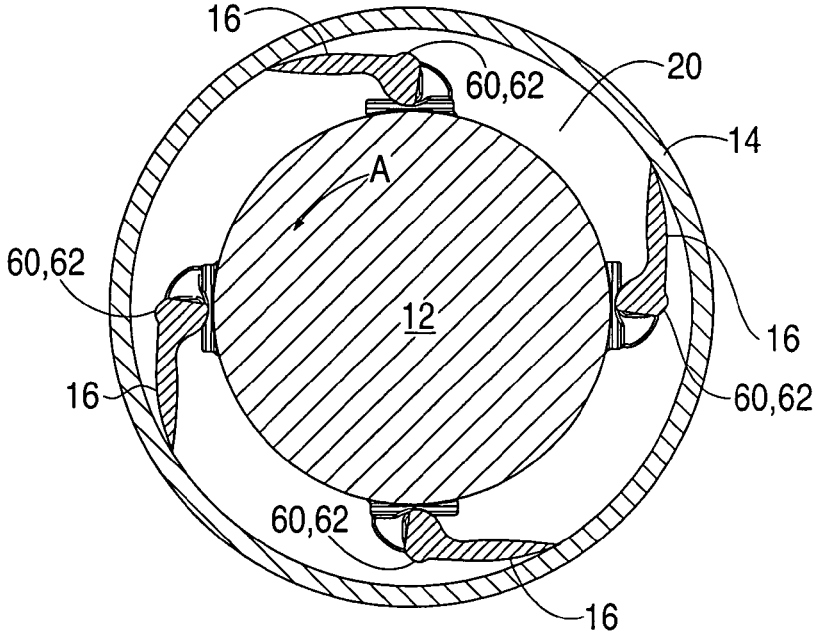
FIG. 16 is a cross sectional view taken through line 16—16 in FIG. 15, further showing an outer housing tube and a plurality of blades each having a plurality of alternative protective nub rests.
Figure 17:
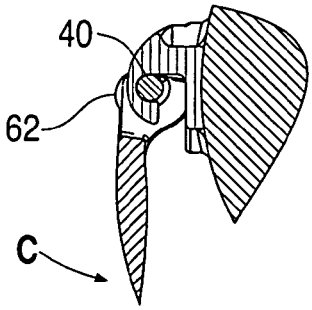
FIG. 17 is a cross sectional view taken through line 17—17 in FIG. 15 showing the blade in the configuration also shown in FIG. 15, but showing an alternative blade having a protective nub rest.

FIG. 15 for example shows a combination of nubs 60 which are provided on the center locking member 38 of the blade 16, and nubs 62 which are provided at the opposite sides of the cutouts 36. It is not necessary or even always preferable to have both nub locations 60 and 62. Rather, a use of either nubs 60 or nub 62 may be sufficient. Moreover, although the locations 60 and 62 are examples of preferred locations for the nubs, it will be appreciated that depending on the overall shape and length of the blade and other factors, it may be desirable to put the nubs anywhere on any surfaces or blade that faces generally outwardly in the installed state, so that these nubs will extend radially outward past the pins in the generally installed state and thereby a protective rest surface upon which the drive shaft pin and blade assembly can rest without the pins contacting the inside of the outer housing 14.

Figure 19:
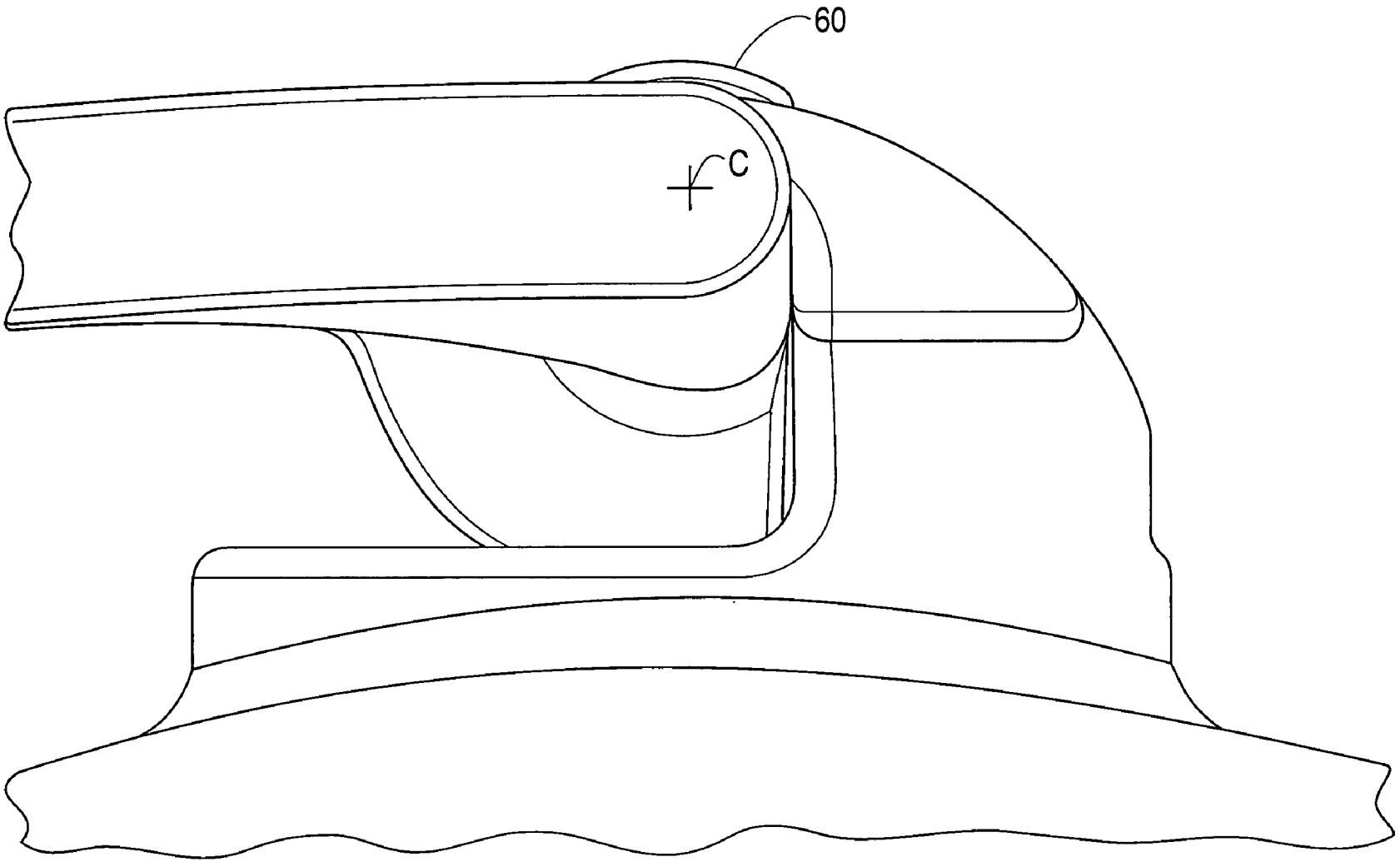
FIG. 19 is a detailed view showing a nub rest protruding from a blade.
Figure 20:
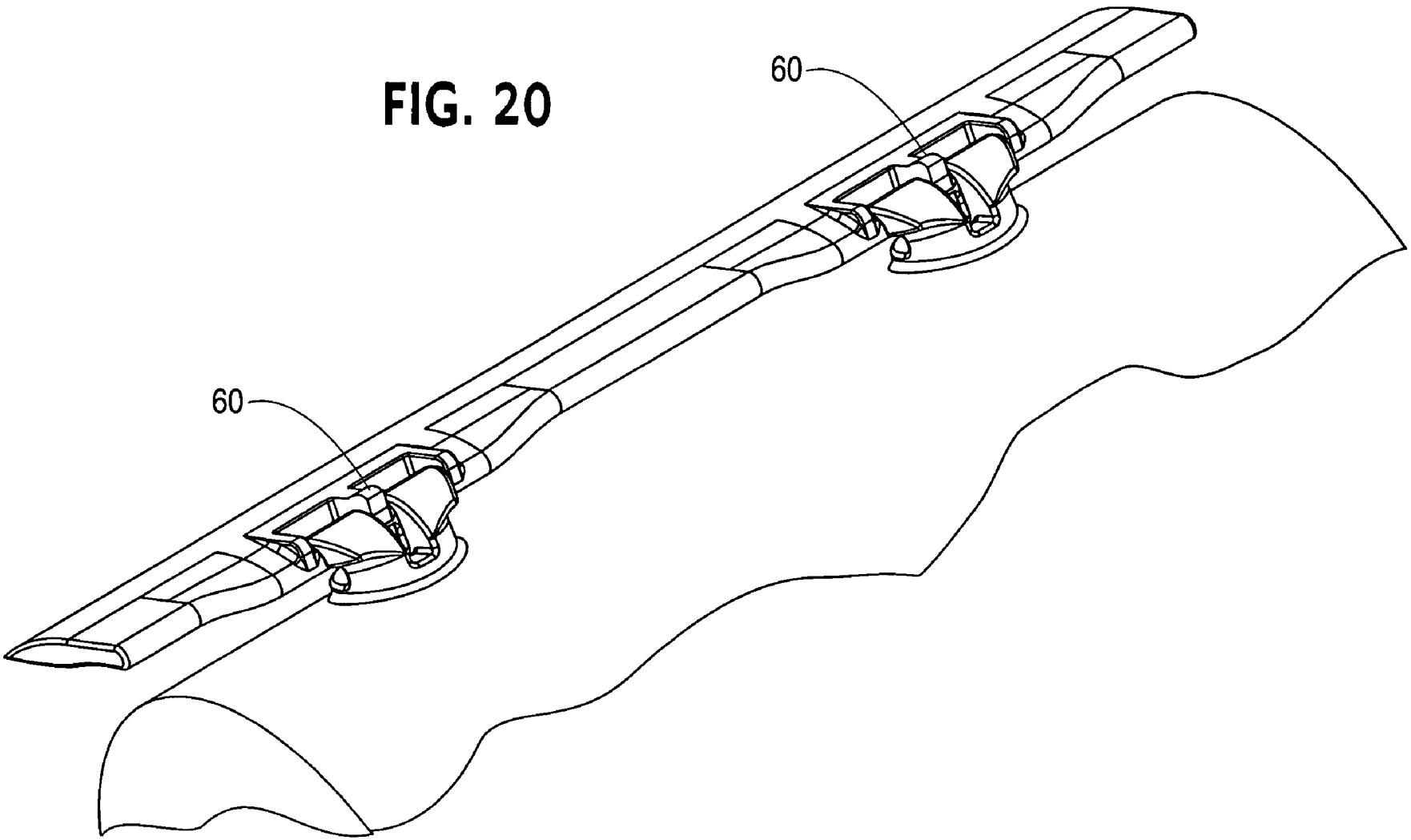
FIG. 20 is a perspective view of a mounted blade showing one configuration of an alternative protective nub rest.

FIG. 19 for example illustrates an embodiment having only the central nubs 60. In this preferred example, the outer contour of the protective nub 60 is in the outline of a circle having a central radius indicated by the mark C. The center point C of the arc of the outer surface of the nub 60 may also preferably be located at the pivot point of rotation of the blade 16 within its pin 18. In the illustrated embodiment, this will also be the center point and access of rotation of the attachment the cylindrical attachment beam 40. FIG. 20 is a perspective view of the embodiment of FIG. 19.

Returning to FIG. 18, it will be appreciated that the shaft 12 has been disconnected from its support bearings and the force of gravity has caused it to drop in the direction indicated by the arrow D until it comes to rest on the nubs 60 and/or 62 that are provided. The amount of the projection of the nubs is selected so that regardless of the overall angle of rotation of the drive shaft 12, the overall assembly will still come to rest at two contact points of nubs 60 and 62 on two respective blades 16.

Since the blades may be selected to be made of polymer materials in many preferred instances, the nubs therefore provide a sliding surface of polymer material on the inside of the housing tube 14, which depending on the material of the pins themselves, which is typically metal, provides significantly less if any damage to the inside surface finish of the housing tube 14.

In the illustrated preferred embodiments, the nubs are integrally formed, most preferably by being molded integrally with the remainder of the blade 16. However, particularly if the material of the blade 16 does not provide desirable protective sliding characteristics, in alternative embodiments the nubs may be discrete components made of a different material from the rest of the blade that are bonded glued or otherwise affixed to an outward facing surface of the blade, with sufficient projection to achieve the resting protective properties described above.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A scraped heat exchanger apparatus comprising:

a drive shaft with at least one outwardly directed blade mounting pin with the driveshaft movable between a supported, operative position and an unsupported, non-operative position;

a housing tube having an inwardly facing inner surface; and at least four blades, each blade comprising a body having a cross section spanning between a first tip end and a second mounting end, and at least one projecting nub integral with the body and projecting generally radially outwardly from the blade body when the blade is in a mounted state, said nub dimensioned to project radially outwardly past the pin when the blade is in the mounted state, wherein the nub is dimensioned to provide a resting surface against the inner surface of the tube so that the nub of at least two blades supports the blades, the pin and the drive shaft when the blade, the pin and the drive shaft are in the unsupported, non-operative position in the housing tube, and wherein none of the nubs are in contact with the tube when the driveshaft is in the supported position.

2. An apparatus according to claim 1, further comprising two said nubs spaced along the length of said blade.

3. An apparatus according to claim 1, wherein the blade is a unitary molded blade.

4. An apparatus according to claim 1, wherein the blade is manufactured from a polymer material.

5. An apparatus according to claim 1, wherein the blade is manufactured from polyaryletherketone.

6. An apparatus according to claim 1, wherein in cross section, said nub has an outer facing surface having a circular curvature to its profile.

7. An apparatus according to claim 6, wherein the blade has at least one attachment beam associated with said pin and configured to restrain said blade with respect to said pin, while permitting some rotation of said blade with respect to said pin around said attachment beam.

8. An apparatus according to claim 7, wherein the curvature of said nub is centered around a point coincident with the axis of rotation of said attachment beam.

9. An apparatus according to claim 1, wherein said nub is located proximate said mounting end of the blade.

10. A scraped heat exchanger apparatus comprising:

a drive shaft with at least one outwardly directed blade mounting pin with the driveshaft movable between a supported, operative position and an unsupported, non-operative position;

a housing tube having an inwardly facing inner surface; and at least four blades, each blade comprising a body having a cross section spanning between a first tip end and a second mounting end, and at least one supporting means integral with the body and projecting generally radially outwardly from the blade body when the blade is in a mounted state, said supporting means having a nub dimensioned to project radially outwardly past the pin when the blade is in the mounted state, wherein the supporting means is dimensioned to provide a resting surface against the inner surface of the tube so that the supporting means of at least two blades supports the blades, the pin and the drive shaft when the blade, the pin and the drive shaft are in the unsupported, non-operative position in the housing tube, and wherein none of the supporting means are in contact with the tube when the driveshaft is in the supported position.

11. An apparatus according to claim 10, wherein the supporting means comprising two nubs spaced along the length of said blade.

12. An apparatus according to claim 10, wherein the blade is a unitary molded blade.

13. An apparatus according to claim 10, wherein the blade is manufactured from a polymer material.

14. An apparatus according to claim 10, wherein the blade is manufactured from polyaryletherketone.

15. An apparatus according to claim 10, wherein in cross section, the supporting means has an outer facing surface having a circular curvature to its profile.

16. An apparatus according to claim 15, wherein the blade has at least one attachment beam associated with said pin and configured to restrain said blade with respect to said pin, while permitting some rotation of said blade with respect to said pin around said attachment beam.

17. An apparatus according to claim 16, wherein the curvature of said supporting means is centered around a point coincident with the access of rotation of said attachment beam.

* * * * *